US010165819B2

(12) United States Patent
Klotz et al.

(10) Patent No.: US 10,165,819 B2
(45) Date of Patent: Jan. 1, 2019

(54) HELMET ACCESSORY ADAPTER

(75) Inventors: Robert Klotz, Jefferson Hills, PA (US); Rebecca Kreke, Pittsburgh, PA (US); Kevin R. Ketterer, Portersville, PA (US)

(73) Assignee: MSA Technology, LLC, Cranberry Township, PA (US)

( * ) Notice: Subject to any disclaimer, the term of this patent is extended or adjusted under 35 U.S.C. 154(b) by 655 days.

(21) Appl. No.: 13/435,588

(22) Filed: Mar. 30, 2012

(65) Prior Publication Data

US 2012/0246807 A1 Oct. 4, 2012

Related U.S. Application Data

(60) Provisional application No. 61/470,775, filed on Apr. 1, 2011.

(51) Int. Cl.

| | |
|---|---|
| ***A42B 3/16*** | (2006.01) |
| ***A42B 3/04*** | (2006.01) |
| ***A42B 3/22*** | (2006.01) |

(52) U.S. Cl.

CPC ..... *A42B 3/166* (2013.01); *A42B 3/04* (2013.01); *A42B 3/225* (2013.01)

(58) Field of Classification Search

CPC ..... A42B 3/166; A42B 3/04; A42B 3/225

USPC ..... 2/6.3–6.5, 6.7, 8.2, 10, 421, 422, 424, 2/425

See application file for complete search history.

(56) References Cited

U.S. PATENT DOCUMENTS

| | | | | |
|---|---|---|---|---|
| 4,442,551 | A | 4/1984 | Hellberg | |
| 5,546,610 | A * | 8/1996 | Herzig et al. | 2/422 |
| 5,658,065 | A * | 8/1997 | Jamieson | A42B 3/04 2/422 |
| 5,966,738 | A | 10/1999 | Wang Lee | |
| 6,352,383 | B1 * | 3/2002 | Ristola | A42B 3/04 2/10 |
| 6,616,294 | B1 * | 9/2003 | Henry | A42B 3/04 2/422 |
| 6,892,393 | B1 * | 5/2005 | Provost et al. | 2/10 |
| 8,214,920 | B1 * | 7/2012 | Edgar et al. | 2/8.2 |
| 8,225,419 | B2 * | 7/2012 | Hersick et al. | 2/5 |
| 2004/0181856 | A1 | 9/2004 | Oleson | |
| 2004/0199982 | A1 * | 10/2004 | Wang-Lee | A42B 3/225 2/424 |

(Continued)

FOREIGN PATENT DOCUMENTS

JP 63073323 5/1988

*Primary Examiner* — Katherine M Moran

(74) *Attorney, Agent, or Firm* — Bartony & Associates, LLC

(57) ABSTRACT

A system for use in connection with a protective helmet having at least one accessory connection mechanism includes a visor accessory which includes a frame including at least one rearward extending member. The system further includes an adapter including a helmet connector adapted to form a releasable connection with the accessory connection mechanism of the protective helmet and an accessory connector adapted to form a releasable connection with the at least one rearward extending member of the visor accessory. The accessory connector is adapted to be stowed on the at least one rearward extending member when the adapter is not in use to connect to the accessory connection mechanism of the protective helmet.

13 Claims, 8 Drawing Sheets

(56) References Cited

U.S. PATENT DOCUMENTS

2010/0154093 A1* 6/2010 Provost ..... A42B 3/185
2/10

* cited by examiner

Fig. 1A
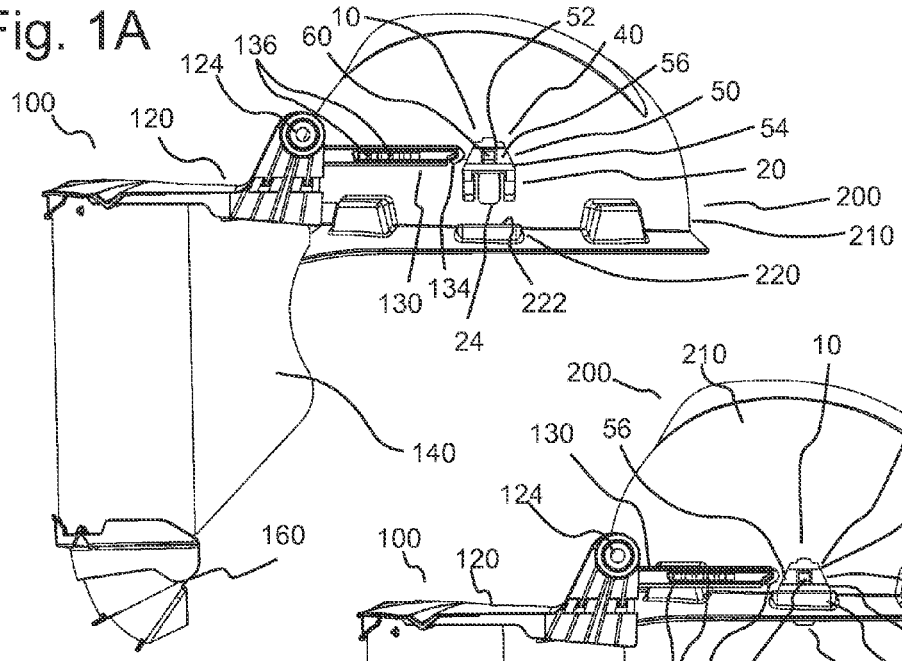
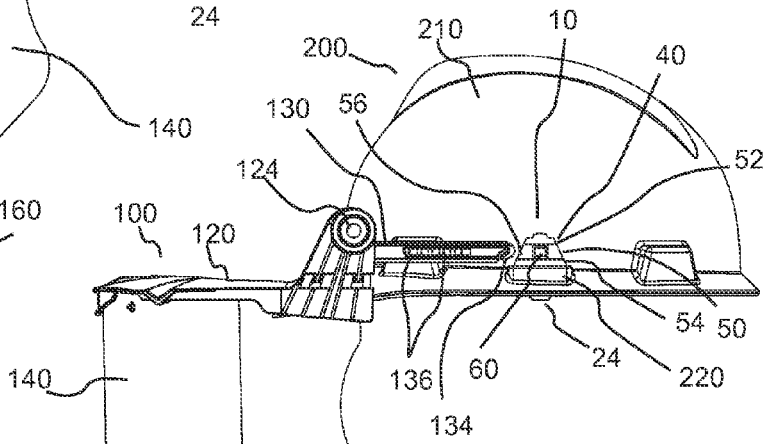
Fig. 1B
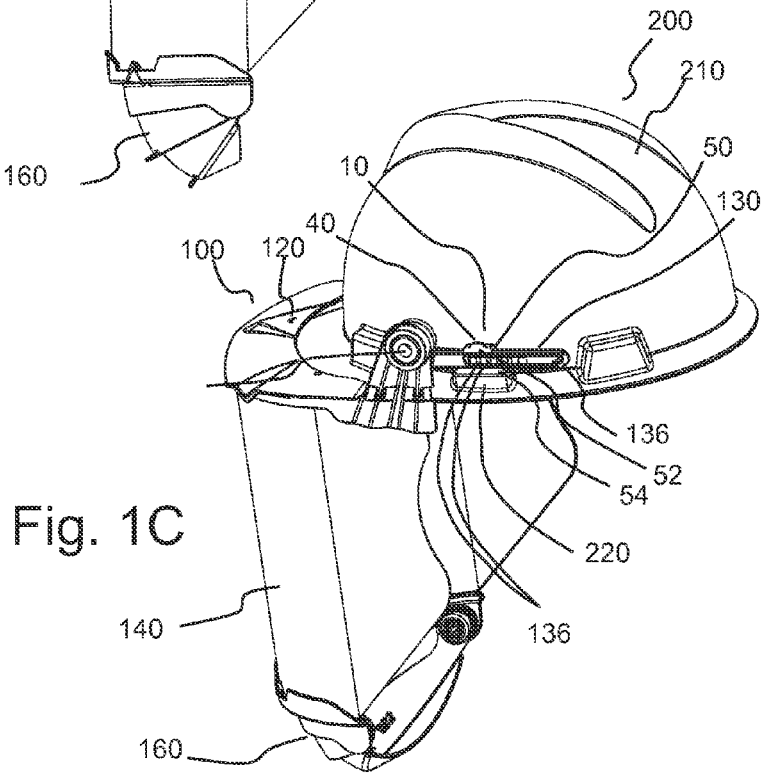
Fig. 1C

Fig. 2A
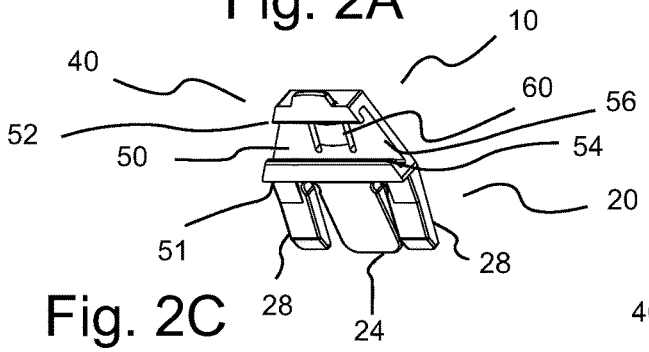
Fig. 2B
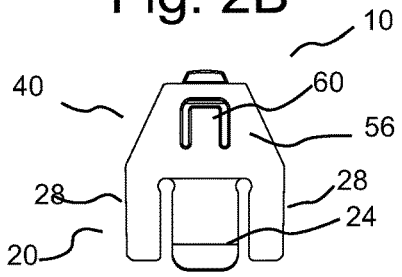
Fig. 2C
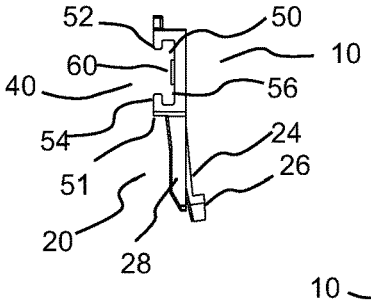
Fig. 2E
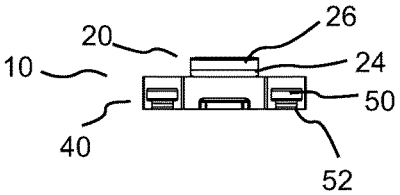
Fig. 2D
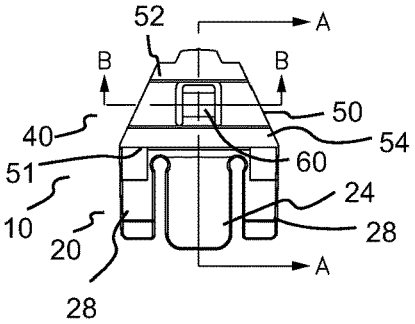
Fig. 2F
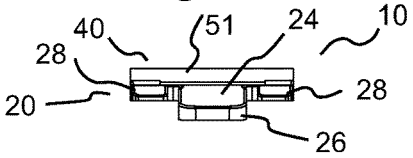
Fig. 2I
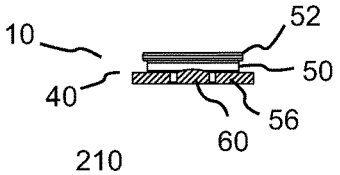
Fig. 2G
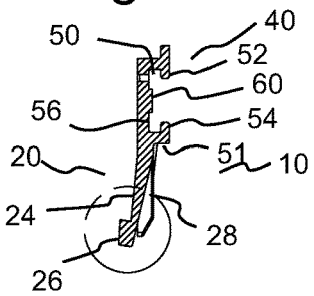
Fig. 2H
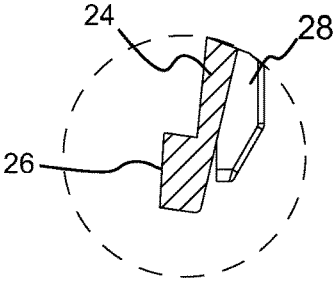
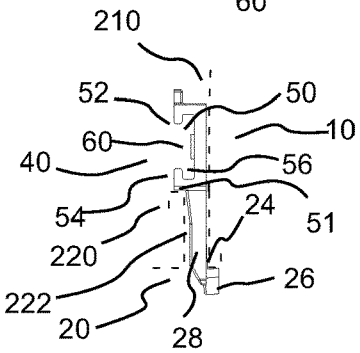
Fig. 2J

HELMET ACCESSORY ADAPTER

CROSS-REFERENCE TO RELATED APPLICATIONS

This application claims benefit of U.S. Provisional Patent Application No. 61/470,775, filed Apr. 1, 2011, the disclosure of which is incorporated herein by reference.

BACKGROUND

The following information is provided to assist the reader to understand the technology described below and certain environments in which such technology can be used. The terms used herein are not intended to be limited to any particular narrow interpretation unless clearly stated otherwise in this document. References set forth herein may facilitate understanding of the technology or the background thereof. The disclosure of all references cited herein are incorporated by reference.

Helmets including rigid outer shells are often worn by persons in situations or occupations wherein head injuries are a significant risk (for example, in manufacturing, construction, mining etc.). Such helmets can, for example, include one or more mechanisms thereon to attach one or more accessories to the helmet. For example, a helmet can include one or more channels or slots into which a connector for an accessory (for example, a visor accessory, a hearing protection accessory, a device holder accessory etc.) can be attached (for example, via a releasable snap fit engagement). For a number of accessories, a separate adapter or connector is provided which includes a connector section to attach to the helmet and another connector section to attach to the accessory. Often, such separate adapters or connectors become lost if not in use for a particular application.

SUMMARY

In one aspect, a system for use in connection with a protective helmet having at least one accessory connection mechanism includes a visor accessory. The accessory connection mechanism of the protective helmet may, for example, include a passage, channel or slot. The visor accessory includes a frame including at least one rearward extending member. The system further includes an adapter including a helmet connector adapted to form a releasable connection with the accessory connection mechanism of the protective helmet and an accessory connector adapted to form a releasable connection with the at least one rearward extending member of the visor accessory. The accessory connector is adapted to be stowed on the at least one rearward extending member when the adapter is not in use to connect to the accessory connection mechanism of the protective helmet.

In a number of embodiment, the accessory connector of the adapter includes an extending channel or slot. The extending channel may, for example, include an open portion. In a number of embodiments, the adapter includes a flexible abutment member extending into the extending channel to cooperate with the at least one rearward extending member. The helmet connector may, for example, include at least one extending flexible member adapted to form a releasable snap fit with the accessory connection mechanism of the protective helmet.

In a number of embodiments, the adapter is rotated approximately 180 degrees from its orientation when connected to the accessory connection mechanism of the protective helmet to an orientation for stowing on the at least one rearward extending member.

In a number of embodiments, the system further includes at least one hearing protection accessory. The hearing protection accessory includes a helmet connector to connect the at least one hearing protection accessory to the accessory connection mechanism of the protective helmet and an accessory connector adapted to connect an accessory to the hearing protection accessory. The accessory connector of the hearing protection accessory is adapted to cooperate with the at least one rearward extending member of the accessory to connect the accessory to the hearing protection accessory while the adapter is stowed on the at least one rearward extending member.

In another aspect, an adapter for use in connection with a protective helmet includes at least one accessory connection mechanism to connect an accessory to the protective helmet. As described above, the accessory connection mechanism of the protective helmet may, for example, include a passage, channel or slot. The adapter includes a helmet connector adapted to form a releasable connection with the accessory connection mechanism of the protective helmet and an accessory connector adapted to form a releasable connection with the accessory. The accessory connector of the adapter is adapted to releasably connect the adapter to the accessory when the adapter is not in use to connect to the accessory to the helmet.

In a number of embodiments, the accessory connector of the adapter includes an extending channel or slot. The extending channel may, for example, include an open portion. In a number of embodiments, the adapter includes a flexible abutment member extending into the extending channel to cooperate with the at least one rearward extending member.

In a number of embodiments, the helmet connector includes at least one extending flexible member adapted to form a releasable snap fit with the accessory connection mechanism of the protective helmet.

In a further aspect, a method for connecting accessories to a protective helmet having at least one accessory connection mechanism, includes: providing a visor accessory, the visor accessory including a frame including at least one rearward extending member; providing an adapter including a helmet connector adapted to form a releasable connection with the accessory connection mechanism of the protective helmet, and an accessory connector adapted to form a releasable connection with the at least one rearward extending member of the visor accessory, the accessory connector being adapted to be stowed on the at least one rearward extending member when the adapter is not in use to connect to the accessory connection mechanism of the protective helmet; and providing at least one hearing protection accessory. The hearing protection accessory includes a helmet connector to connect the at least one hearing protection accessory to the accessory connection mechanism of the protective helmet and an accessory connector adapted to connect an accessory to the hearing protection accessory. The accessory connector of the hearing protection accessory is adapted to cooperate with the at least one rearward extending member of the frame of the visor accessory to connect the visor accessory to the hearing protection accessory while the adapter is stowed on the at least one rearward extending member. The accessory connector of the hearing protection accessory may, for example, include at least one channel or slot.

The technology described herein, along with the attributes and attendant advantages thereof, will best be appreciated and understood in view of the following detailed description taken in conjunction with the accompanying drawings.

BRIEF DESCRIPTION OF THE DRAWINGS

FIG. 1A illustrates a side view of a helmet and a visor accessory in which an embodiment of an adapter hereof for connection of the visor accessory to the helmet is positioned to be connected with an accessory connection mechanism of the helmet.

FIG. 1B illustrates a side view of the helmet of FIG. 1A wherein the adapter is operatively connected to the accessory connection mechanism of the helmet and an extending member or rail of the visor accessory is positioned to be slid into connection with an accessory connector of the adapter.

FIG. 1C illustrates a perspective view of the helmet of FIG. 1A wherein the extending member or rail of the visor accessory has been slid into connection with the accessory connector of the adapter.

FIG. 2A illustrates a perspective view of the embodiment of an adapter as illustrated in FIG. 1A.

FIG. 2B illustrates an inner side view of the adapter of FIG. 1A.

FIG. 2C illustrates a front view of the adapter of FIG. 1A.

FIG. 2D illustrates an outer side view of the adapter of FIG. 1A.

FIG. 2E illustrates a top view of the adapter of FIG. 1A.

FIG. 2F illustrates a bottom view of the adapter of FIG. 1A.

FIG. 2G illustrates a cross-sectional view of the adapter of FIG. 1A along section A-A of FIG. 2D.

FIG. 2H illustrates an enlarged view of the encircled portion of FIG. 2A of the adapter of FIG. 1A.

FIG. 2I illustrates a cross-sectional view of the adapter of FIG. 1A along section B-B of FIG. 2D.

FIG. 2J illustrates a front view of the adapter of FIG. 1A in operative connection with a channel or slot of an accessory connection mechanism of a helmet wherein a portion of the helmet and accessory connection mechanism thereof are shown in broken lines.

DETAILED DESCRIPTION

Figure 1D:
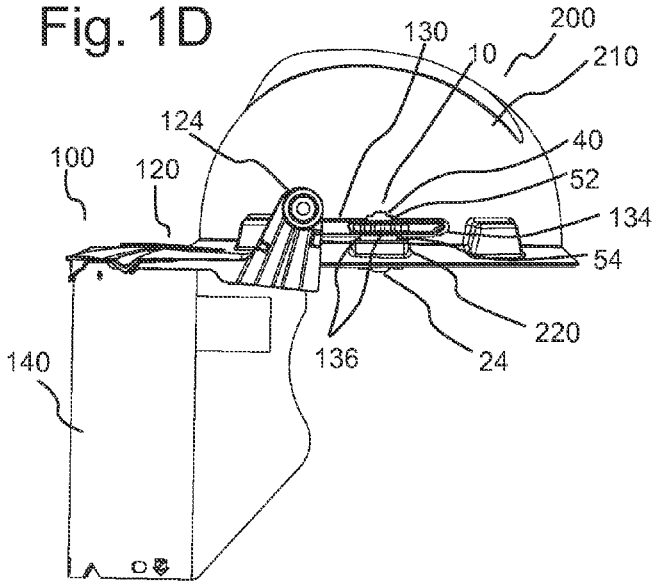
FIG. 1D illustrates a side view of the helmet of FIG. 1A wherein the extending member or rail of the visor accessory has been slid into connection with the accessory connector of the adapter.

As used herein and in the appended claims, the singular forms "a," "an", and "the" include plural references unless the content clearly dictates otherwise. Thus, for example, reference to "an adapter" includes a plurality of such adapters and equivalents thereof known to those skilled in the art, and so forth, and reference to "the adapter" is a reference to one or more such adapters and equivalents thereof known to those skilled in the art, and so forth.

In a number of embodiments hereof, helmet accessory adapters include a first connector or helmet connector to connect the adapter to a helmet accessory connection mechanism (for example, including a passage, channel or slot) of a helmet and a second connector or accessory connector to connect to a first helmet accessory. The second connector or accessory connector is also adapted to connect the adaptor to the first accessory in a stowed position when the adapter is not needed to connect to the helmet. In a number of embodiments, the first accessory includes a connector (for example, a frame or a portion thereof) designed to cooperate with the adapter or with a second accessory (for example, a helmet-mounted hearing protector accessory). The second accessory may, for example, include a first connector or helmet connector to connect second accessory to the accessory connection mechanism of the helmet and a second connector or accessory connector adapted to connect the connector of the first accessory to the second accessory. The adapter is designed or adapted to allow the adapter to be stored or stowed on the first accessory when the adapter is not needed to attach the first accessory to the helmet (for example, when the second accessory is attached to the helmet and the first accessory may be attached to the second accessory). The adapter may be removed from storage or stowage on the first accessory and assembled on the helmet to connect the first accessory to the helmet when needed.

For example, in the case of a first accessory or a frame used in connection with a visor to be connected with a helmet, the frame may be connected to the helmet via two adapters hereof which connected to accessory connection mechanisms on each side of the helmet. The adapters cooperate with rearward (with respect to the orientation of the helmet when worn by a user) extending members of the accessory which operatively connect to the adapters. If another or second accessory is to be connected to the helmet which does not require the adapters for connection (for example, a hearing protection accessory or accessories), the adapter may be stowed or stored in connection with the first accessory.

In a number of embodiments, hearing protection accessories for use in systems hereof include a first connector to connect to an accessory connection mechanism of the helmet and a second connector to form an operative connection with rearward extending members of, for example, a visor frame. The visor frame may be connected to the helmet using adapters hereof. However, when it is desirable to use hearing protection accessories, the adapters may be removed from connection with the helmet and stowed upon the visor frame accessory. After connection of the hearing protection accessories to the helmet, the visor frame accessory may be placed in operative connection with the hearing protection accessories with the adapter stowed thereon. If it is subsequently desirable to remove the hearing protection accessories and attach the visor frame accessory to the helmet, the adapters may be removed from stowage on the visor frame accessory and used to attach the visor frame accessory to the helmet.

FIGS. 1A through 1E illustrate an embodiment of an adapter 10 hereof for use in attaching a visor accessory 100 (or other accessory) to a helmet 200. Visor accessory 100 includes a frame 120 to which a visor 140 is attachable. A chin guard 160 may, for example, be attached to a lower end of visor 140. FIG. 1A illustrates a side view of helmet 200 and visor accessory 100 with adapter 10 positioned to be placed in operative connection with an accessory connector or accessory connection mechanism 220 (for example, an accessory passage, channel or slot) of helmet 200. In the illustrated embodiment, helmet 200 includes a rigid shell 210 of a polymeric material into which accessory connection mechanism 220 is monolithically formed. A helmet connector or connector section 20 of adapter 10 includes one or more flexible extending members 24, which may, for example, form a removable or releasable snap fit connection with accessory connection mechanism 220 (see, for example, FIGS. 2A through 2J). In the illustrated embodiment, flexible extending member 24 includes a flange or abutment member 26, which snaps into an abutting connection with accessory connection mechanism 220. In that regard, accessory connection mechanism 220 includes a passage, channel or slot 222 (see, for example, FIG. 2J) into which extending member 24 and one or more extending stabilizing members 28 of adapter 10 are passed. Channel 222 may, for example, be dimensioned such that stabilizing member 28 from a relatively snug fit therein. Abutment member 26, upon passing the lower edge of channel 222 flexes or snaps inward (or to the right in the orientation of FIG. 2J) to form an abutting connection with a lower edge of channel 222. The abutting cooperation of stabilizing members 28 with channel 222, the abutting cooperation of abutment member 26 with the lower edge of channel 222, and the abutting cooperation of a surface 51 of adapter 10 with an upper edge of channel 222 maintain adapter 10 in secure connection with accessory connection mechanism 220. A user may flex extending member 24 outward (or to the left in the orientation of FIG. 2J) to a release position, after connection of adapter 10 to accessory connection mechanism 220, to remove abutment member 26 from abutting connection with accessory connection mechanism 220 to allow removal of adapter 10 from connection with accessory connection mechanism 220.

Adapter 10 further includes an accessory connector or connector section 40 (see, for example, FIGS. 2A through 2G and 2I). In the illustrated embodiment, accessory connection section includes an extending retention channel or a slot 50 formed, in part, by a first flange 52, a second flange 54 and an inner (with respect to the orientation when connected to accessory connection mechanism 220 of helmet 200) wall or surface 56. An extending member or section of an accessory may be slid into connection with retention channel 50 to form a connection therewith. An extending, flexing abutment member 60 may, for example, be formed in wall 56 to contact and form a releasable abutting connection with the extending member of the accessory. In a number of embodiments, adapter 10 is formed monolithically (for example, via a molding process such as an injection molding process) from a polymeric material such as an acetyl polymer.

Figure 1E:
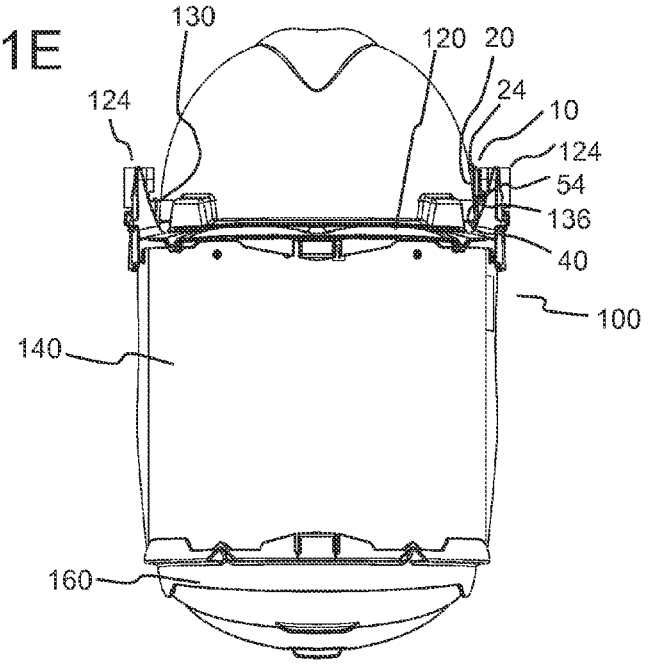
FIG. 1E illustrates a front view of the helmet of FIG. 1A wherein one of the extending members or rails of the visor accessory has been slid into connection with the accessory connector of the adapter to connect the visor accessory to the helmet.

FIG. 1B illustrates adapter 10 operatively connected to accessory connection mechanism 220 of helmet 200. An extending member 130 or rail of frame 120 of visor accessory 100 is positioned to be slid into connection with retention channel 50 of accessory connector 40 of adapter 10. FIG. 1C through 1E illustrate extending member 130 slid into connection with retention channel 50 of accessory connector 40 of the adapter 10. An inner side of extending member 130 may, for example, include a series of raised sections 132 and intermediate depressions or valleys therebetween (see, for example, FIGS. 3G through 3I) that cooperate with and/or releasably engage flexing abutment member 60 to maintain extending member 130 at a desired position relative to adapter 10.

Figure 3A:
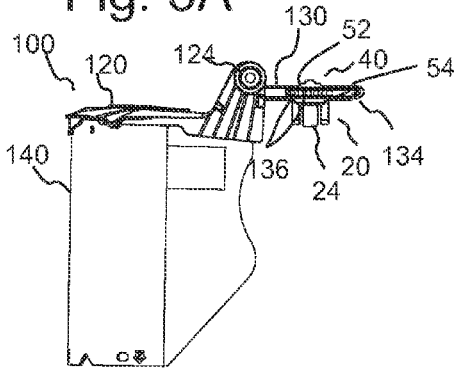
FIG. 3A illustrates a side view of the visor accessory and adapter of FIG. 1A wherein the adapter is connected to an extending member of the visor accessory in a position for use in connection with the helmet accessory connection mechanism.
Figure 3B:
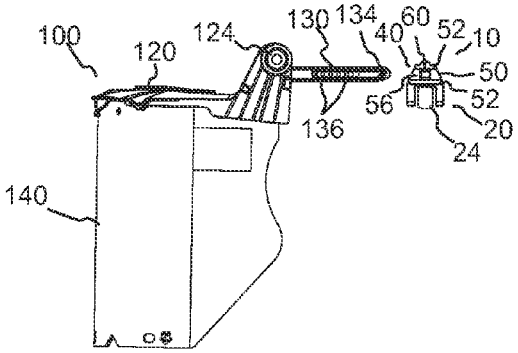
FIG. 3B illustrates a side view of the visor accessory and adapter of FIG. 1A wherein the adapter is removed from connection with the extending member.
Figure 3C:
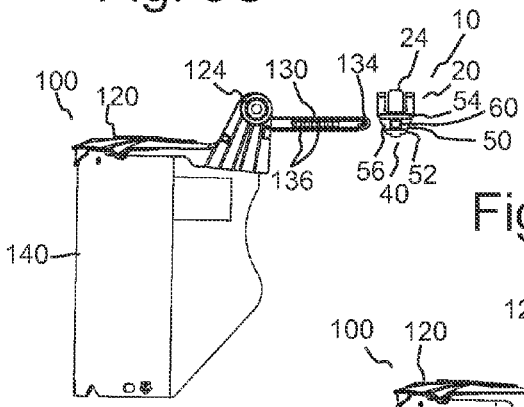
FIG. 3C illustrates a side view of the visor accessory and adapter of FIG. 1A wherein the adapter has been vertically flipped or inverted to an orientation in which it may be stowed on the visor accessory.
Figure 3D:
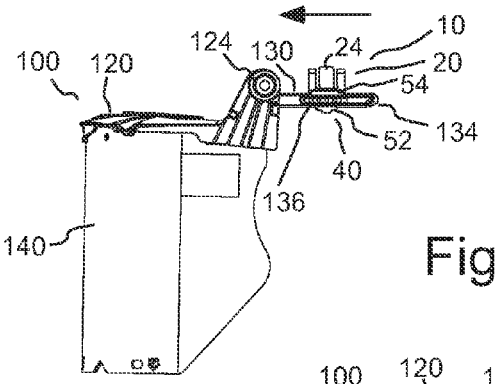
FIG. 3D illustrates a side view of the visor accessory and adapter of FIG. 1A wherein the adapter has been slid partially onto the extending member in the orientation in which it may be stowed on the visor accessory.
Figure 3E:
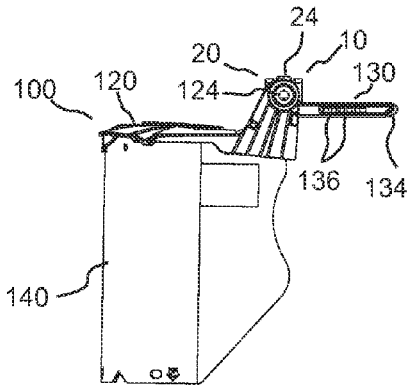
FIG. 3E illustrates a side view of the visor accessory and adapter of FIG. 1A wherein the adapter has been slid to its fully stowed position.
Figure 3F:
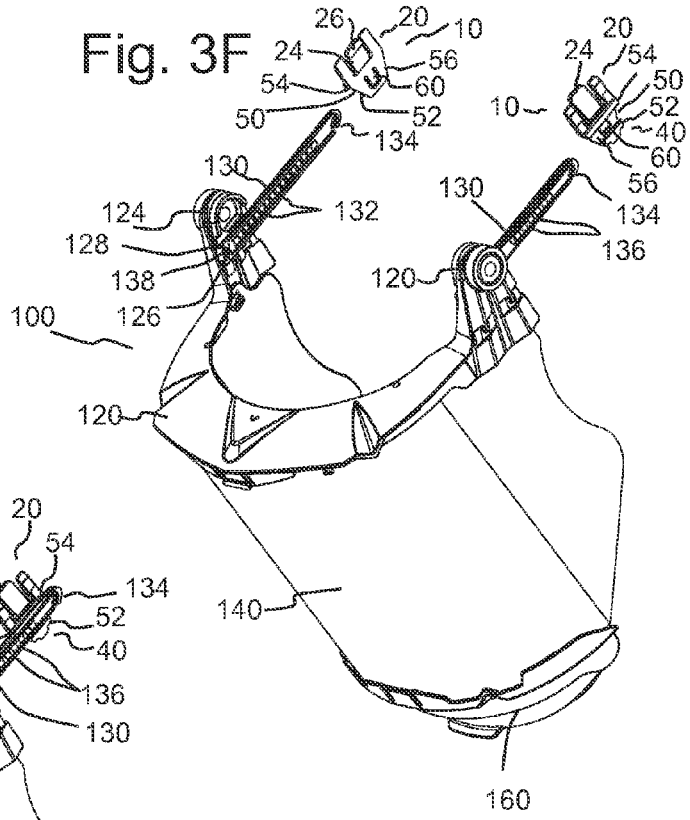
FIG. 3F illustrates a perspective view of the visor accessory and adapter of FIG. 1A wherein the adapter has been vertically flipped or inverted to an orientation in which it may be stowed on the visor accessory.
Figure 3G:
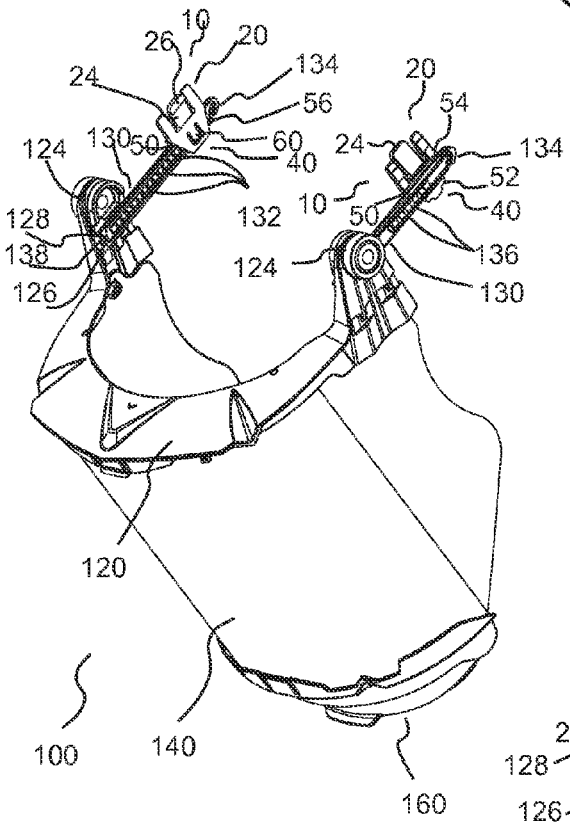
FIG. 3G illustrates a perspective view of the visor accessory and adapter of FIG. 1A wherein the adapter has been slid partially onto the extending member in the orientation in which it may be stowed on the visor accessory.
Figure 3H:
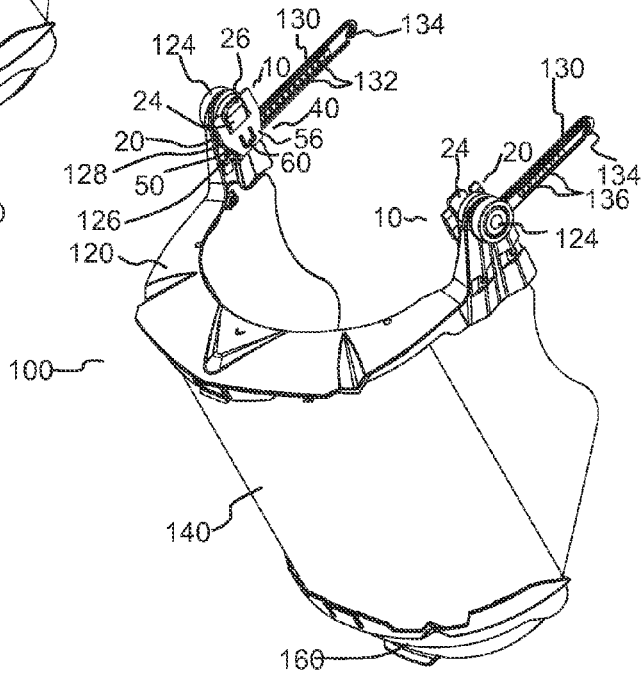
FIG. 3H illustrates a perspective view of the visor accessory of and adapter of FIG. 1A wherein the adapter has been slid to its fully stowed position.

FIGS. 3A through 3J illustrate a sequence of actions via which adapter 10 may be removed from connection with an accessory such as visor accessory 100 and removed from connection with helmet 200 so that adapter 10 may be stowed or stored on the accessory. FIG. 3A illustrates adapter 10 connected to extending member 130 of visor accessory 100 in an orientation for use in connection with helmet accessory connection mechanism 220. In FIG. 3B, adapter 10 has been removed from connection with extending member 130. Extending member 130 may, for example, include a mechanism 134 which must be actuated to remove adapter 10 from connection with extending member 130. Mechanism 134 may, for example, include a flexible, extending abutment member 134 that may be flexed by the user to allow adapter 10 to be removed from extending member 130. In the illustrated embodiment, extending abutment member 134 angles in a forward direction so that adapter 10 may readily be slid into connection with extending member 130, but abutment member 134 contacts adapter 10 upon sliding adapter 10 rearward along extending member 130 to assist in avoiding unintended disconnection. In FIG. 3B, adapter 10 is illustrated as having been removed from connection with extending member 130. In FIGS. 3C and 3F, adapter 10 is inverted so that helmet connector 20 is oriented upward. In this position, channel 50 of adapter 10 is slid forward into connection with extending member 130 as illustrated in FIGS. 3D and 3G, until it reaches its fully stowed position inward of a joint 124 connecting extending member 130 to a forward portion of frame 120 as illustrated in FIGS. 3E and 3H.

Figure 3I:
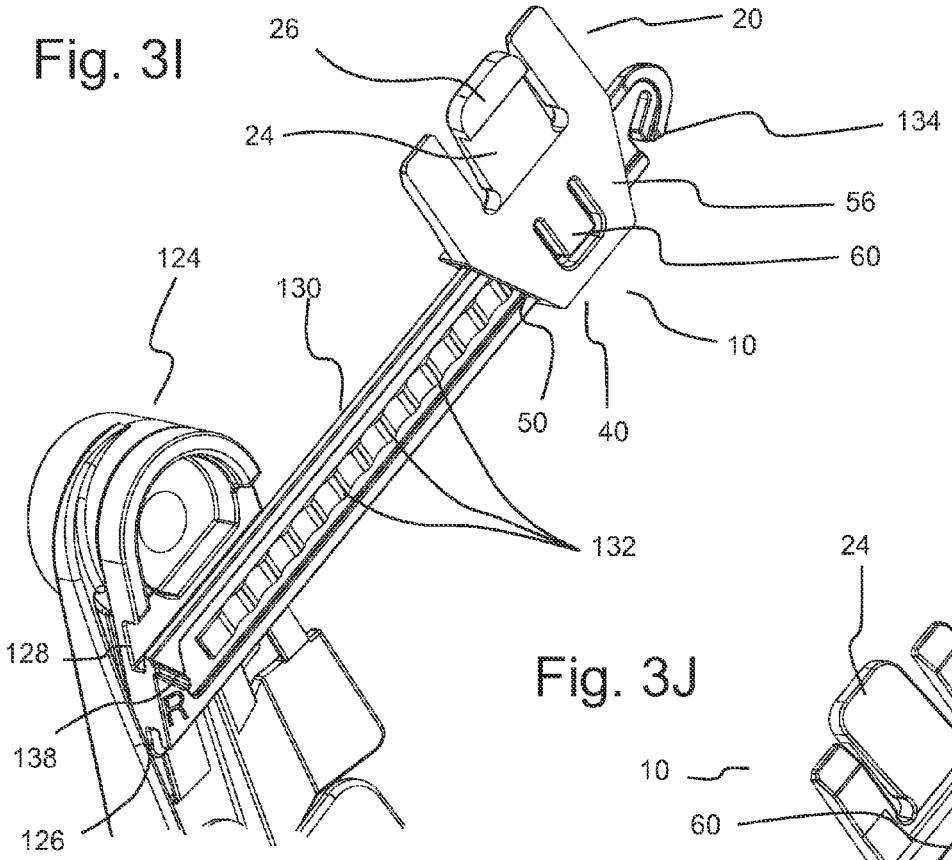
FIG. 3I illustrates an enlarged, perspective view of an inner side of an extending member of the visor accessory and the adapter of FIG. 1A wherein the adapter has been slid partially onto the extending member in the orientation in which it may be stowed on the visor accessory.
Figure 3J:
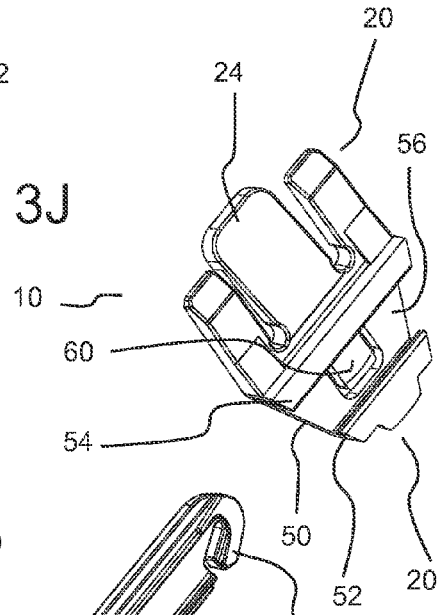
FIG. 3J illustrates an enlarged, perspective view of an outer side of an extending member of the visor accessory and the adapter of FIG. 1A wherein the adapter has been vertically flipped or inverted to an orientation in which it may be stowed on the visor accessory.
Figure 3J:
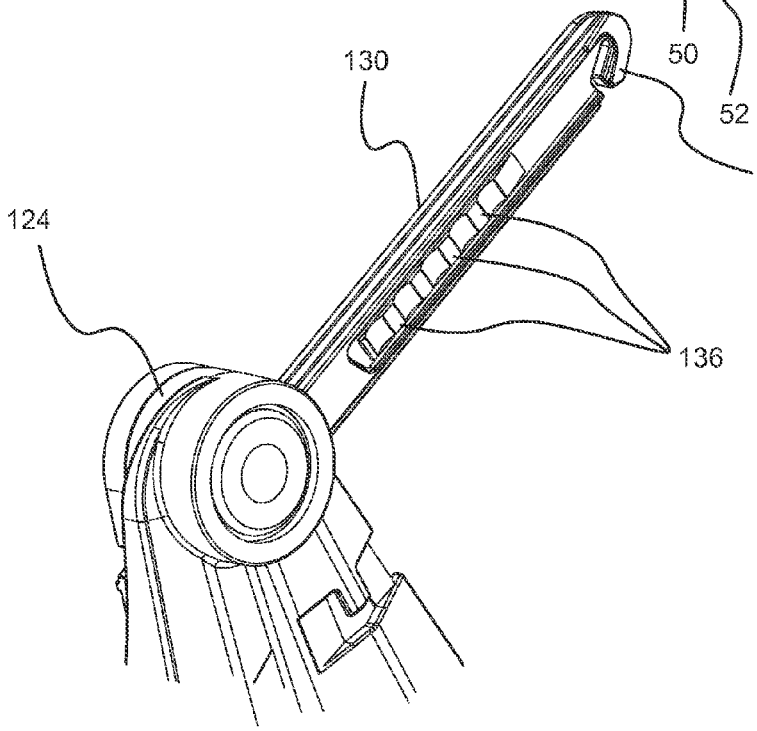

As illustrated in, for example, FIG. 3I, extending member 130 may include an abutment member or surface 138 on or near a forward end thereof, which is abutted by adapter 10 to position adapter 10 inward of joint 124 and to prevent adapter 10 from being disconnected from extending member 130 when slid in a forward direction. Channel 50 of adapter 10 is formed with an open portion between first flange 52 and second flange 54 so that adapter 10 may be stowed inward of joint 124. First flange 52 and second flanges 54 slide into engagement with recesses 126 and 128 respectively formed in joint or joint assembly 124 as illustrated in FIGS. 3F through 3I.

Figure 4A:
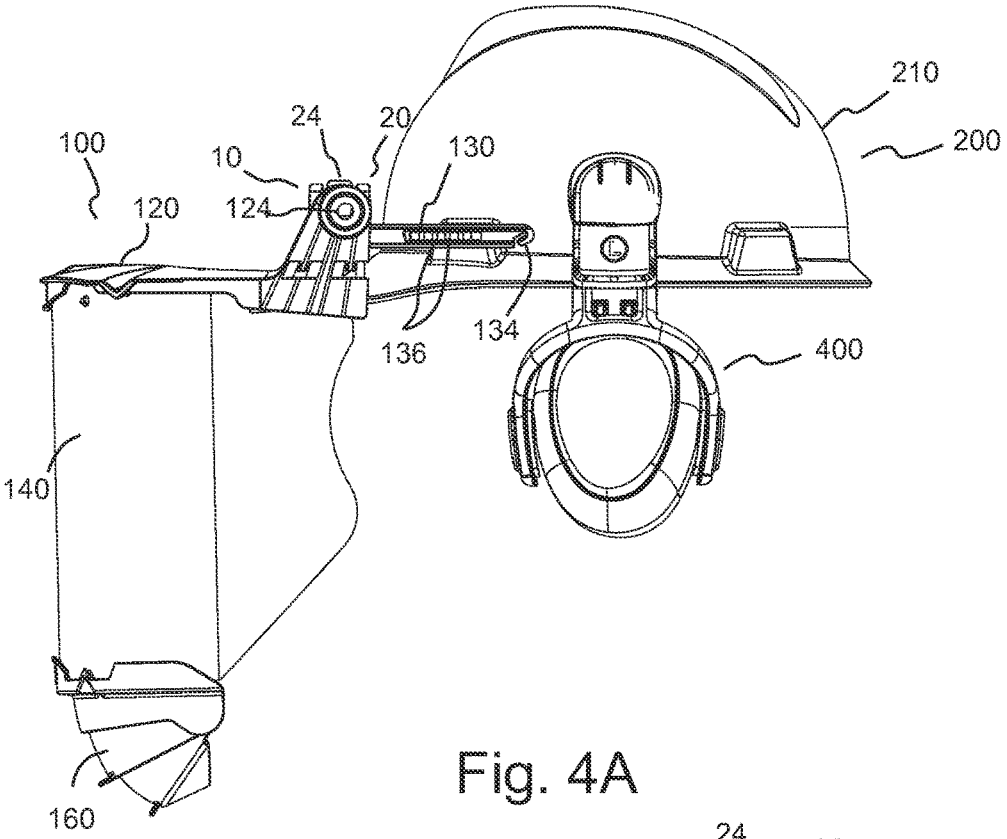
FIG. 4A illustrates a side view of the helmet of FIG. 1A with a hearing protection accessory attached to the accessory connection mechanism of the helmet and the extending member of the visor accessory, with the adapter stowed thereon, in position for attachment with an accessory connector of the hearing protection accessory.
Figure 4B:
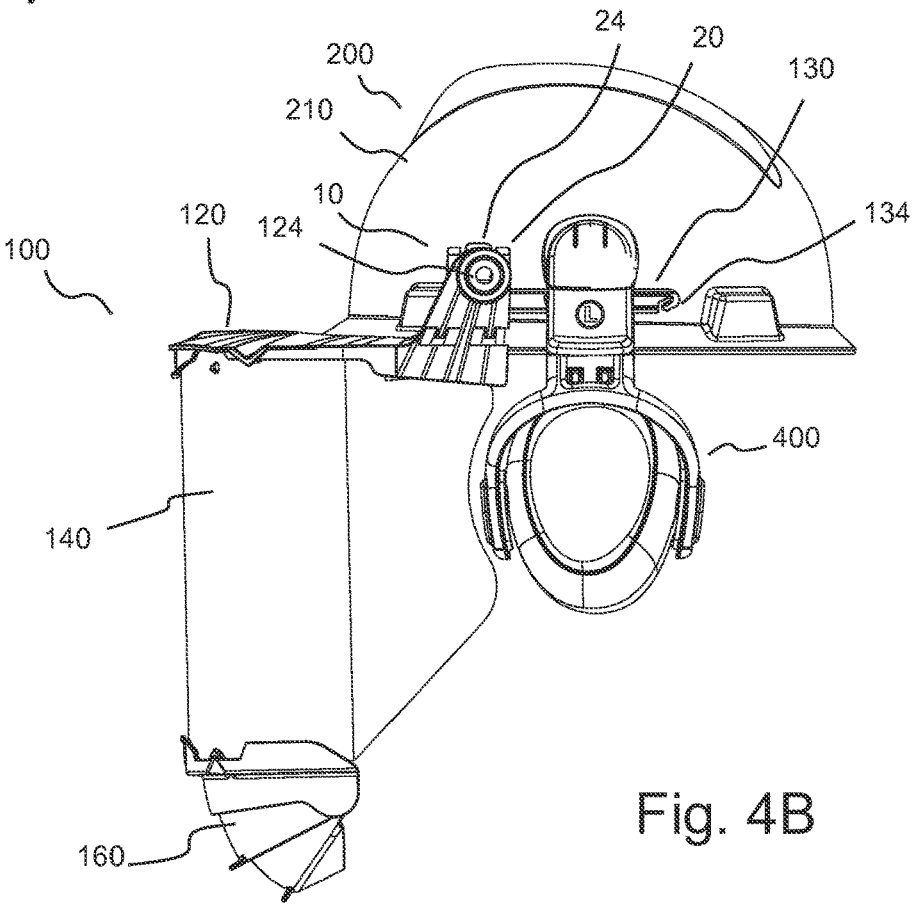
FIG. 4B illustrates a side view of the helmet of FIG. 1A with an hearing protection accessory attached to the accessory connection mechanism of the helmet and the extending member of the visor accessory, with the adapter stowed thereon, attached to an accessory connector of the hearing protection accessory.
Figure 4C:
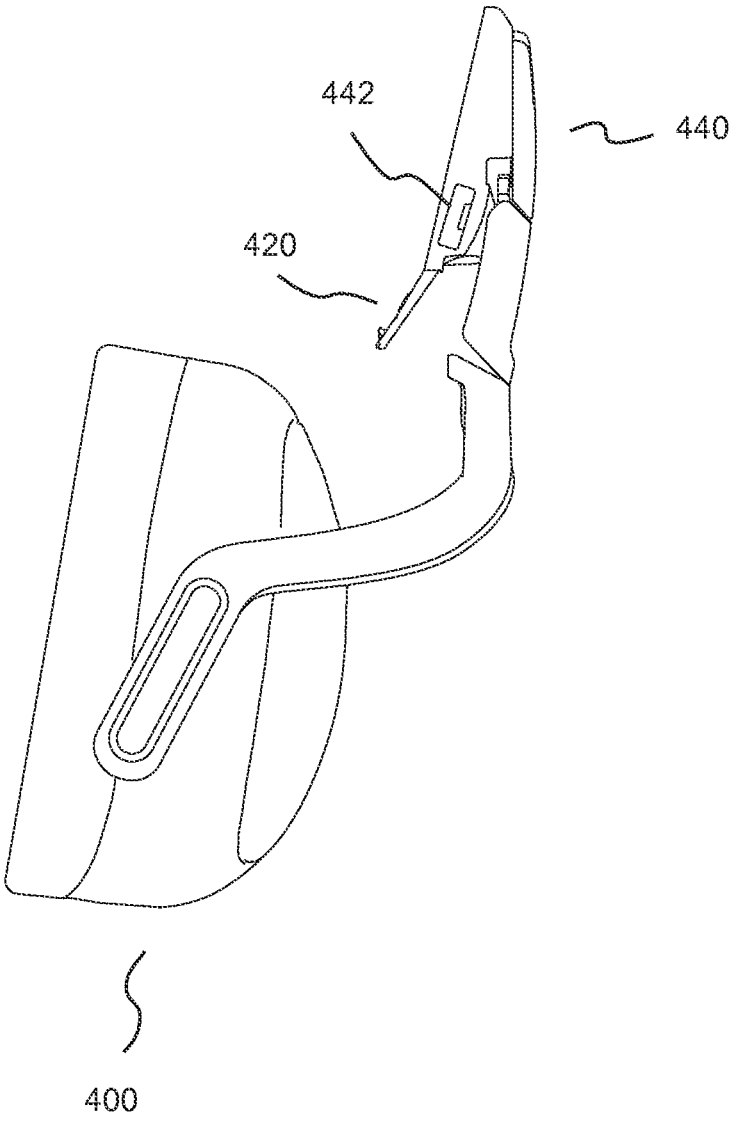
FIG. 4C illustrates a front view of the hearing protection accessory illustrating a connector thereof for use in connection to the accessory connection mechanism of the helmet of FIG. 1A and an accessory connector thereof for use in connection of the extending member of the visor accessory thereto.

With adapter 10 in the stowed position illustrated in FIGS. 3E and 3H, extending members 130 of visor accessory 100 may be slid into connection with, for example, hearing protection accessories 400 as illustrated in FIGS. 4A and 4B. One of such hearing protection accessories may be placed on each side of helmet 200 to protect the hearing of a user of helmet 200. As illustrated in FIG. 4C, hearing protection accessory 400 includes a helmet connector 420 and an accessory connector 440. In the illustrated embodiment, accessory connector 440 includes passages 442 through which extending member 130 may be slid to connect visor accessory 100 to hearing protection accessory 400 and, thereby, to helmet 200. An outer surface or side of extending member 130 may, for example, include a series of raised sections 136 and intermediate depressions or valleys therebetween that cooperate with accessory connector 440 to position extending member 130 at a desired position relative to accessory connector 440 and helmet 200. If the user decides to remove hearing protection accessories 400, visor accessory 100 may be reattached to helmet 200 via adapters 10, which are safely stowed on visor accessory 100 as described above.

The foregoing description and accompanying drawings set forth a number of representative embodiments at the present time. Various modifications, additions and alternative designs will, of course, become apparent to those skilled in the art in light of the foregoing teachings without departing from the scope hereof, which is indicated by the following claims rather than by the foregoing description. All changes and variations that fall within the meaning and range of equivalency of the claims are to be embraced within their scope.

What is claimed is:

1. A system for use in connection with a protective helmet having at least one accessory connection mechanism, comprising:

a visor accessory comprising a frame comprising at least one rearward extending member, an adapter comprising a lower helmet connector to form a releasable connection with the accessory connection mechanism of the protective helmet, and an upper accessory connector extending above a rim of the protective helmet when the lower helmet connector forms a releasable connection with the accessory connection mechanism to form a releasable connection with the at least one rearward extending member of the visor accessory via an extending channel of the upper accessory connector through which the rearward extending member is slidable to releasably connect the visor accessory to the protective helmet, the extending channel of the upper accessory connector being adapted to connect to the rearward extending member to stow the adapter on the at least one rearward extending member when the lower helmet connector of the adapter is removed from connection with the accessory connection mechanism of the protective helmet and when the visor accessory is placed in connection with the helmet via another accessory connected to the protective helmet via the accessory connection mechanism of the protective helmet, wherein the at least one rearward extending member is slidable through the extending channel of the upper accessory connector when the adapter is rotated 180 degrees from its orientation when connected to the accessory connection mechanism of the protective helmet to position the adapter at a forward position on the at least one rearward extending member so that a length of the at least one rearward extending member extends rearward from the adapter to place the visor accessory in connection with the another accessory via cooperation of the length of the at least one rearward extending member with the another accessory.

2. The system of claim 1 wherein the lower helmet connector of the adapter comprises an extending member to form a releasable connection with a channel of the accessory connection mechanism of the protective helmet.

3. The system of claim 1 wherein the adapter is formed monolithically from a polymeric material.

4. The system of claim 1 wherein the extending channel of the upper accessory connector comprises an open portion through which the at least one extending member is slidable.

5. The system of claim 4 wherein the upper accessory connector comprises a flexible abutment member extending into the extending channel to cooperate with the at least one rearward extending member.

6. The system of claim 4 wherein the lower helmet connector comprises at least one extending flexible member adapted to form a releasable snap fit with the accessory connection mechanism of the protective helmet.

7. A system for use in connection with a protective helmet having at least one accessory connection mechanism, comprising:

a visor accessory comprising a frame comprising at least one rearward extending member;

an adapter comprising a helmet connector to form a releasable connection with the accessory connection mechanism of the protective helmet, and an accessory connector to form a releasable connection with the at least one rearward extending member of the visor accessory via an extending channel of the accessory connector which is slidably connectable with the rearward extending member to releasably connect the visor accessory to the protective helmet, the extending channel of the accessory connector being adapted to connect to the rearward extending member to stow the adapter on the at least one rearward extending member when the helmet connector of the adapter is removed from connection with the accessory connection mechanism of the protective helmet and when the visor accessory is placed in connection with the helmet via another accessory connected to the protective helmet via the accessory connection mechanism of the protective helmet, wherein the at least one rearward extending member is slidable through the extending channel of the accessory connector to position the adapter at a forward position on the at least one rearward extending member so that a length of the at least one rearward extending member extends rearward from the adapter to place the visor accessory in connection with the another accessory via cooperation the length of the at least one rearward extending member with the another accessory; and at least one hearing protection accessory, the hearing protection accessory comprising a helmet connector to connect the at least one hearing protection accessory to the accessory connection mechanism of the protective helmet and an accessory connector adapted to connect an accessory to the hearing protection accessory, the accessory connector of the hearing protection accessory being adapted to cooperate with the at least one rearward extending member of the frame of the visor accessory to connect the visor accessory to the hearing protection accessory while the adapter is stowed on the at least one rearward extending member.

8. A method for connecting accessories to a protective helmet having at least one accessory connection mechanism, comprising:

providing a visor accessory, the visor accessory comprising a frame comprising at least one rearward extending member;

providing an adapter comprising a helmet connector adapted to form a releasable connection with the accessory connection mechanism of the protective helmet, and an accessory connector adapted to form a releasable connection with the at least one rearward extending member of the visor accessory via an extending channel of the accessory connector which is slidably connectable with the rearward extending member to connect the visor accessory to the protective helmet, the accessory connector being adapted to be stowed on the at least one rearward extending member when the helmet connector of the adapter is removed from connection with the accessory connection mechanism of the protective helmet and when the visor accessory is placed in connection with the helmet via another accessory connected to the protective helmet via the accessory connection mechanism of the protective helmet;

providing at least one hearing protection accessory, the hearing protection accessory comprising a helmet connector to connect the at least one hearing protection accessory to the accessory connection mechanism of the protective helmet and an accessory connector adapted to connect an accessory to the hearing protection accessory, the accessory connector of the hearing protection accessory comprising at least one channel through which the at least one rearward extending member of the frame of the visor accessory is extendible to connect the visor accessory to the hearing protection accessory;

sliding the adapter on the rearward extending member via the extending channel of the accessory connector to stow the adapter on the at least one rearward extending member and so that a length of the at least one rearward extending member extends rearward from the adapter; and connecting length of the at least one rearward extending member to the hearing protection accessory at a position on the at least one rearward extending member rearward of a position at which the adapter is stowed by extending the length of the at least one rearward extending member through the at least one channel of the hearing accessory.

9. The method of claim 8 further comprising forming the adapter monolithically from a polymeric material.

10. The method of claim 8 wherein the accessory connector of the adapter comprises an extending channel comprising an open portion.

11. The method of claim 10 wherein the accessory connector of the adapter comprises a flexible abutment member extending into the extending channel of the accessory connector to cooperate with the at least one rearward extending member.

12. The method of claim 10 wherein the helmet connector comprises at least one extending flexible member adapted to form a releasable snap fit with the accessory connection mechanism of the protective helmet.

13. The method of claim 8 wherein the adapter is rotated 180 degrees from an orientation for connection to the accessory connection mechanism of the protective helmet to slide onto the at least one rearward extending member to stow the adapter on the at least one rearward extending member.

* * * * *